US012325565B2

(12) United States Patent
Barrette et al.

(10) Patent No.: US 12,325,565 B2
(45) Date of Patent: Jun. 10, 2025

(54) CHILD-RESISTANT CONTAINER COVER

(71) Applicant: JAM PACKAGING LLC, Miami Gardens, FL (US)

(72) Inventors: Alex Nunes Barrette, Sunrise, FL (US); Robert William Linggi, Davis, CA (US)

(73) Assignee: JAM PACKAGING LLC, Miami Gradens, FL (US)

( * ) Notice: Subject to any disclaimer, the term of this patent is extended or adjusted under 35 U.S.C. 154(b) by 39 days.

(21) Appl. No.: 18/500,654

(22) Filed: Nov. 2, 2023

(65) Prior Publication Data

US 2024/0158142 A1 May 16, 2024

Related U.S. Application Data

(60) Provisional application No. 63/383,209, filed on Nov. 10, 2022.

(51) Int. Cl.
*B65D 50/00* (2006.01)
*B65D 43/02* (2006.01)

(52) U.S. Cl.
CPC ..... *B65D 50/00* (2013.01); *B65D 43/0256* (2013.01); *B65D 2215/00* (2013.01); *B65D 2543/00092* (2013.01); *B65D 2543/00537* (2013.01); *B65D 2543/00648* (2013.01); *B65D 2543/00685* (2013.01); *B65D 2543/00759* (2013.01); *B65D 2543/00805* (2013.01)

(58) Field of Classification Search
CPC ..... B65D 43/0256; B65D 2215/00; B65D 50/00; B65D 50/06
USPC ..... 220/268, 270
See application file for complete search history.

(56) References Cited

U.S. PATENT DOCUMENTS

| | | | | | |
|---|---|---|---|---|---|
| 1,655,111 | A * | 1/1928 | Taliaferro | B65D 55/0845 | 292/256.61 |
| 2,941,660 | A * | 6/1960 | Tupper | B65D 43/0274 | 229/233 |
| 3,979,003 | A * | 9/1976 | Allen | B65D 43/0256 | 215/256 |
| 2002/0125250 | A1* | 9/2002 | Fang | B65D 43/0212 | 220/780 |
| 2005/0092751 | A1* | 5/2005 | Alvares | B65D 21/0219 | 220/276 |
| 2006/0266750 | A1* | 11/2006 | Lesquir | B65D 43/0256 | 220/276 |

(Continued)

*Primary Examiner* — Jeffrey R Allen
(74) *Attorney, Agent, or Firm* — Lott & Fischer, PL

(57) ABSTRACT

A child-resistant cover for a container with a rim having a first diameter and a second diameter smaller than the first diameter; the cover comprising a top wall, a release band, one or more tabs, and a plurality of locking elements; the top wall comprising an exterior and interior surface, and a peripheral edge; the release band extending downward from the peripheral edge and comprising a top and bottom edge, an inner and outer surface, and a thickness; the top edge having one or more permanent attachment points and one or more break-away attachment points; the one or more tabs extending upward on or near the top wall peripheral edge; the plurality of locking elements extending inwardly from the release band inner surface, defining a diameter smaller than the first diameter and larger than the second diameter of the rim, and adapted to engage the container rim to prevent removal.

17 Claims, 7 Drawing Sheets

(56) References Cited

U.S. PATENT DOCUMENTS

| | | | | |
|---|---|---|---|---|
| 2006/0266751 | A1* | 11/2006 | Ali | B65D 81/3453 220/780 |
| 2008/0006630 | A1* | 1/2008 | Messina | B65D 17/4012 220/269 |
| 2011/0024421 | A1* | 2/2011 | Luburic | B65D 43/161 220/265 |
| 2016/0023815 | A1* | 1/2016 | Siskindovich | B65D 1/34 220/270 |

* cited by examiner

CHILD-RESISTANT CONTAINER COVER

CLAIM OF PRIORITY

This application is being filed as a non-provisional patent application under 35 U.S.C. § 111(a) and 37 CFR § 1.53(b). This application claims priority under 35 U.S.C. § 119(e) to U.S. provisional patent application Ser. No. 63/383,209 filed on Nov. 10, 2022, the contents of which are incorporated herein by reference.

FIELD OF INVENTION

The present invention relates to a cover for a container. More specifically, the invention relates to a child-resistant cover that is adapted for mounting on a container having a rim, such as a can, containing a beverage or other contents.

BACKGROUND

Liquids, powders, and the like, are often stored in containers, having an operable opening mechanism at an end. These containers are often equipped with a rim located at or near the end with the opening mechanism. For example, liquid beverages are usually stored in cylindrical aluminum cans having a "pop-top" or pull tab at one end and a circular rim at or near the same end. These pull tabs allow the user to open the container to easily access the contents within it.

However, some contents that are stored in containers are not necessarily safe for children. For example, alcoholic beverages which can be unsafe for young children are often stored in such containers. Therefore, it is sometimes desirable to prevent, or at least make it more difficult, for children to gain access to the contents of the container. However, these containers often do not include any child-resistant mechanisms to prevent children from gaining access to the contents of the container. Therefore, there exists a need to provide a child-resistant cover to retrofit such a container.

SUMMARY OF THE INVENTION

It is among the objects of this invention to overcome the limitations of the heretofore-known devices by providing inventive features to achieve: a.) a retrofit cover to existing containers; b.) a child-resistant mechanism to prevent, or at least make it more difficult, for children to access the contents of the container; c.) accessibility of the contents in a container with a child-resistant mechanism for adults; and d.) the ability to stack such containers.

It is an object of the present invention to provide a child-resistant cover for mounting on a container, the container comprising a circular rim, the rim defining a first diameter at a periphery of the container and a second diameter smaller than the first diameter and directly below the periphery of the container. In one embodiment, the child-resistant cover comprises a top wall, a release band, one or more tabs, and a plurality of locking elements.

The top wall comprises an exterior surface, an opposing interior surface, and a peripheral edge.

The release band extends downward from the peripheral edge of the top wall, and the release band comprises a top edge, a bottom edge, an inner surface, an opposing outer surface, and a thickness.

The top edge of the release band further comprises a first portion and a second portion. The first portion of the top edge of the release band is permanently attached to the top wall by one or more permanent attachment points, and the second portion of the top edge of the release band is removably attached to the top wall by one or more break-away attachment points.

The one or more tabs extend upward on or near the peripheral edge of the top wall.

The plurality of locking elements extends inwardly from the inner surface of the release band, and the plurality of locking elements defines a diameter that is smaller than the first diameter of the rim, but larger than the second diameter of the rim. The plurality of locking elements is adapted to engage the circular rim of the container and to prevent removal of the child-resistant cover from the container once engaged.

In some embodiments of the present invention, the top wall is solid and/or opaque. In other embodiments, the top wall can be transparent or may contain openings or a pattern of openings extending from the exterior surface to the interior surface which make it easier to discern the opening mechanism which is blocked from the user by the top wall. The top wall can also have a variety of shapes. For example, in some embodiments, the top wall can be planar, or non-planar. In non-planar embodiments of the top wall, the top wall may be convex or concave.

In some embodiments of the present invention, the release band may extend completely around the peripheral edge of the top wall, forming a ring. In embodiments where the release band forms a ring, the release band may further comprise a break-off bead extending vertically at a single point from the top edge to the bottom edge of the release band. The break-off bead further comprises a thickness that is smaller than the thickness of the release band in order to facilitate the breaking of the release band to remove the cover by an adult. In such embodiments, one of the one or more tabs may be substantially aligned with the break-off bead in order to provide a greater gripping area.

In other embodiments, the release band may only partially extend around the peripheral edge of the top wall leaving a gap to facilitate gripping the end of the release band. In such embodiments, one of the one or more tabs may be placed at or near the end of the release band to provide an extended gripping area.

In some embodiments of the present invention, at least one of the one or more break-away attachment points comprises a plurality of break-away bridges. In other embodiments, the release band may comprise two or more break-away attachment points, and each of the two or more break-away attachment points may further comprise a plurality of break-away bridges. If multiple break-away attachment points are provided, in some embodiments, each of the break-away attachment points can comprise an equal number of break-away bridges, making the resistance to breakage of each of the break-away attachment points identical. Alternatively, in other embodiments where multiple break-away attachment points are provided, the break-away attachment points can each comprise a different number of break-away bridges. For example, some of the break-away attachment points may have more break-away bridges than other break-away attachment points, thereby making the total resistance to breakage relatively higher when compared with the other break-away attachment points with fewer break-away bridges.

Finally, in some embodiments, the one or more tabs extending upward from the peripheral edge of the top wall can be arranged to receive an end of a second container, enabling the stacking of containers through the use of the disclosed cover.

Although the invention is illustrated and described herein as embodied for use on a can, it is nevertheless not intended to be limited to only the details shown, since various modifications and structural changes may be made therein without departing from the spirit of the invention and within the scope and range of equivalents of the claims.

The construction of the invention, however, together with additional objects and advantages thereof will be best understood from the following description of the specific disclosed embodiments when read in connection with the accompanying drawings.

DETAILED DESCRIPTION OF THE INVENTION

Figure 1A:
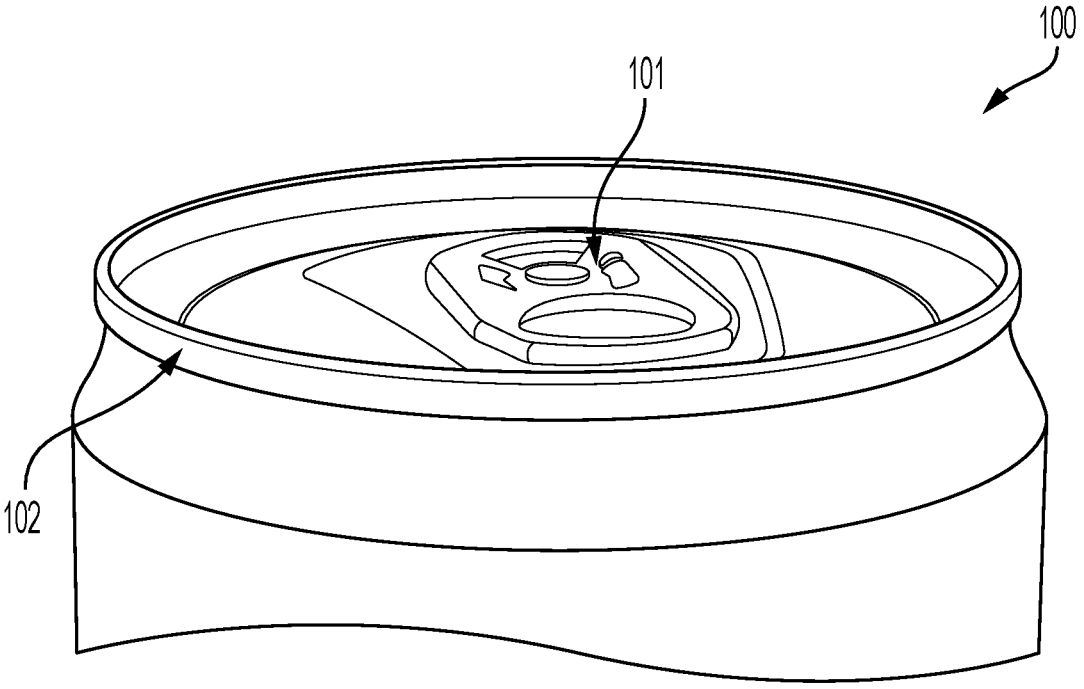
FIG. 1A PRIOR ART
FIGS. 1A and 1B illustrate isometric views of an exemplary container known in the art.
Figure 1B:
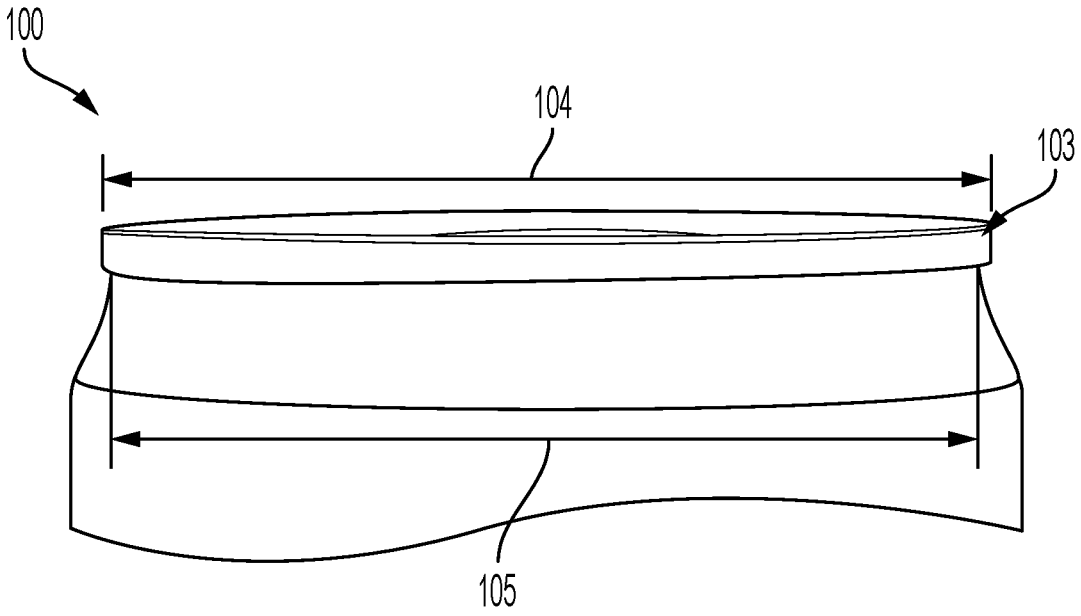
FIG. 1B PRIOR ART

Shown in FIGS. 1A and 1B is an exemplary container (100) known in the art which embodiments of a cover (1) of the present invention are adapted to engage. Specifically, shown is a top of a container (an aluminum can) (100) having an opening mechanism (a pop-top) (101) and a circular rim (102), the rim defining a first diameter (104) at a periphery (103) of the container (100) and a second diameter (105), smaller than the first diameter (104), directly below the periphery (103) of the container (100).

Figure 2A:
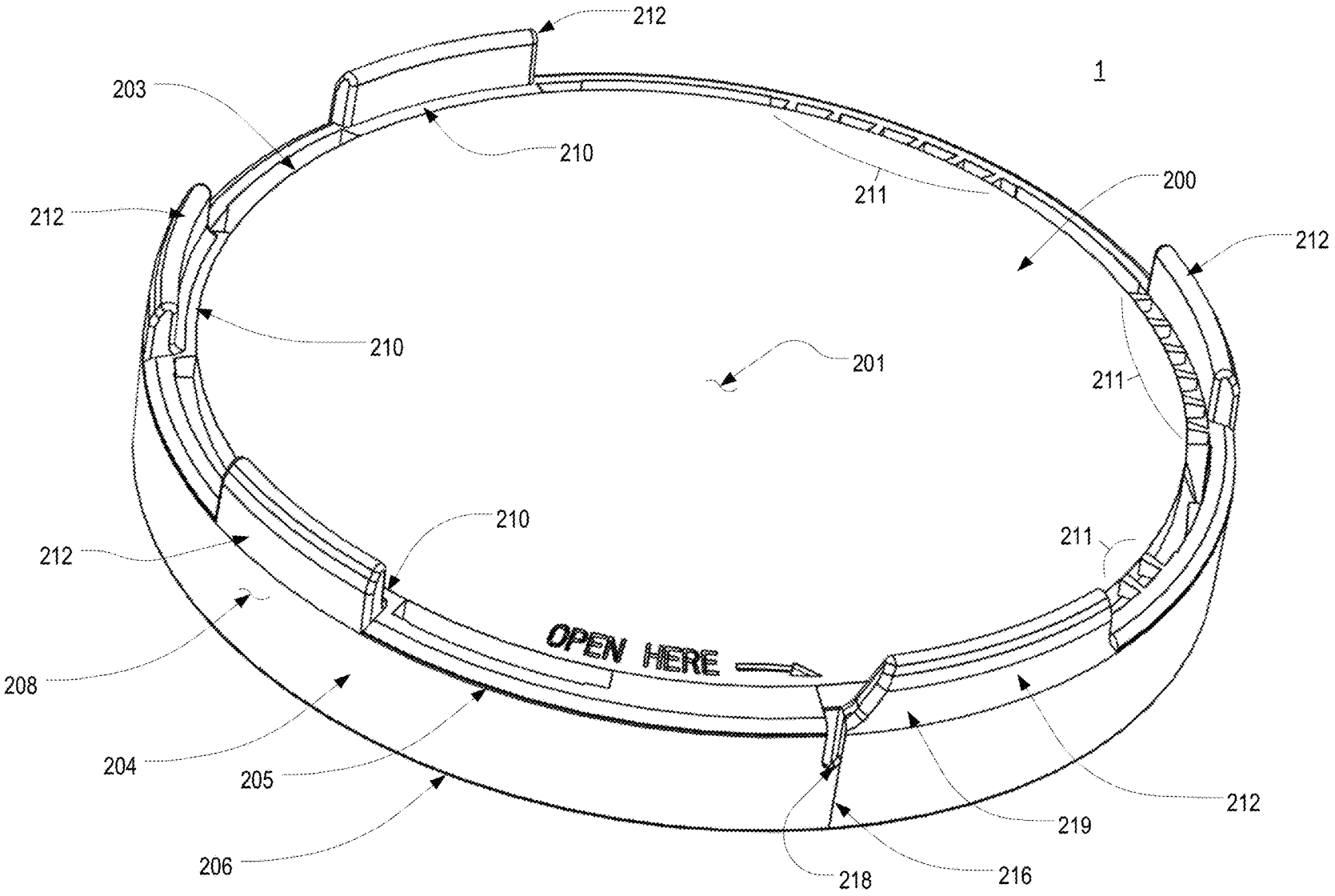
FIGS. 2A and 2B illustrate isometric top and bottom views, respectively, of a cover in accordance with one embodiment of the present invention.
Figure 2B:
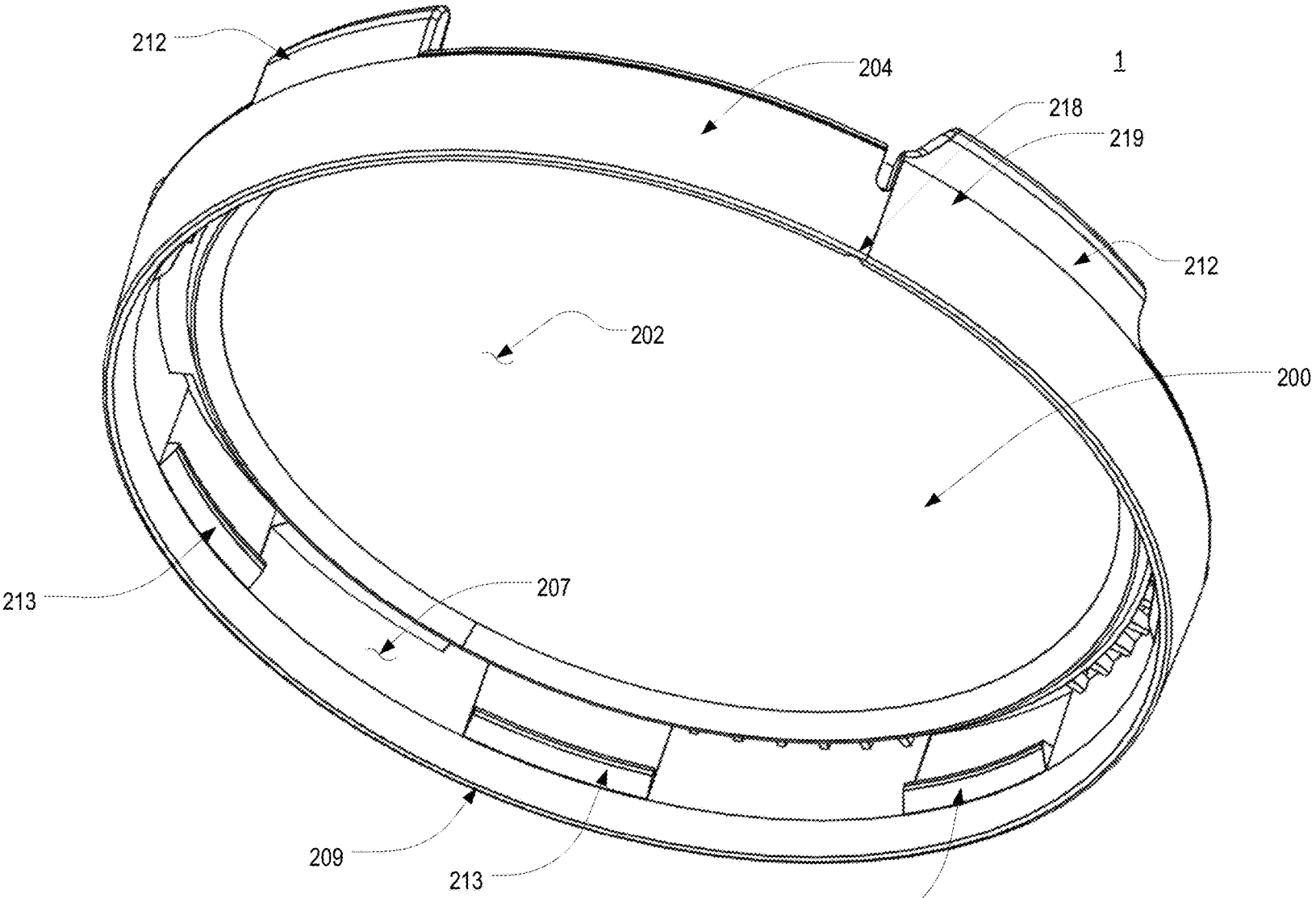

Shown in FIGS. 2A and 2B are isometric top and bottom views of a cover (1) in accordance with one embodiment of the present invention. Although the cover (1) is shown in the present embodiment as adapted to retrofit an aluminum can container (100), in other embodiments in accordance with the present invention the cover (1) may be adapted to fit other types of containers (100). The cover (1) comprises a top wall (200), a release band (204), one or more tabs (212), and a plurality of locking elements (213) in accordance with one embodiment of the present invention.

Referring still to FIGS. 2A and 2B, a top wall (200) in accordance with at least one embodiment of the present invention is shown. The top wall (200) comprises an exterior surface (201), an opposing interior surface (202), and a peripheral edge (203). Although in the depicted embodiment the shape of the top wall (200) is shown as circular, the general shape of the top wall (200) may be similar to that of the shape of the rim (102) or the top of the container (100), but does not necessarily have to match it as long as the top wall (200) sufficiently blocks access to the opening mechanism (101) of the container (100), depicted as a pop-top in FIG. 1A. Furthermore, although the top wall (200) shown in the instant embodiment is planar, opaque, and solid throughout, in other embodiments the top wall (200) may be transparent, have one or more openings or a pattern of openings extending from the exterior surface (201) to the interior surface (202), or be non-planar (e.g., concave, convex, or some other shape). Again, the primary characteristic of the top wall (200) is that it blocks access to the opening mechanism (101) of the container (100).

Figure 5:
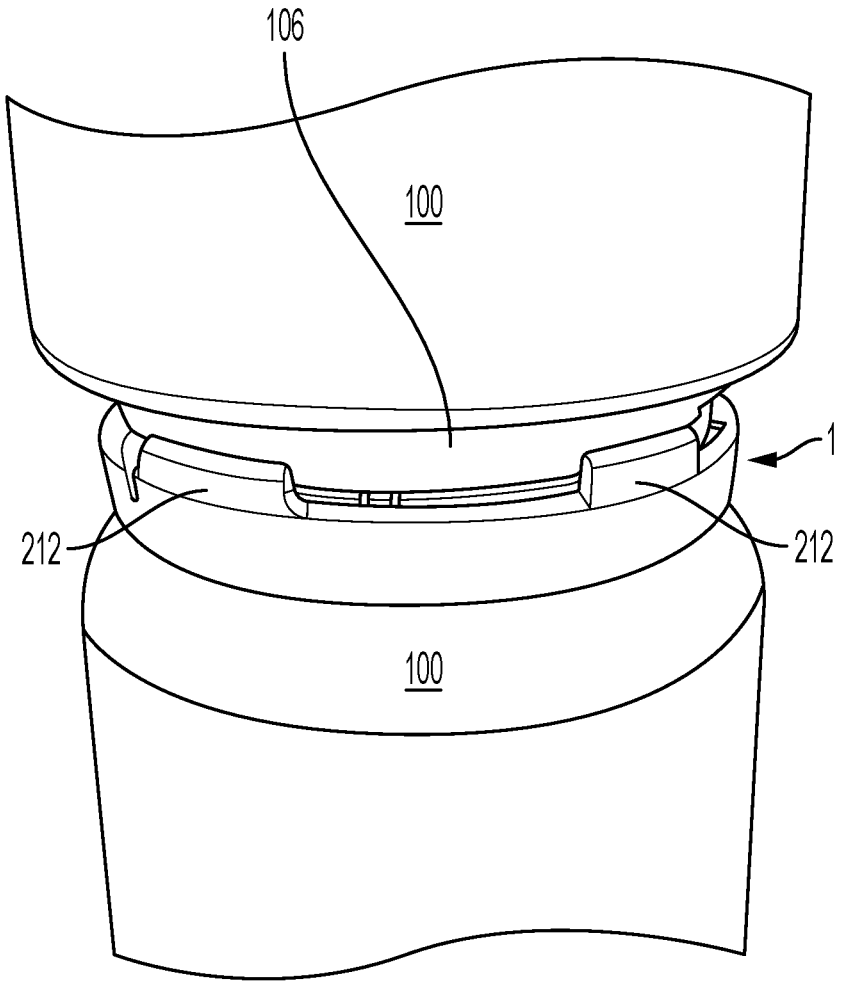
FIG. 5 illustrates an isometric view of stacked containers using a cover in accordance with one embodiment of the present invention.

Referring next to FIGS. 2A, 2B and 5, shown are various views of a cover (1) further comprising one or more tabs (212) in accordance with at least one embodiment of the present invention. The one or more tabs (212) extend vertically upward from points near or at the peripheral edge (203) of the top wall (200). In at least one embodiment in accordance with the present invention, the one or more tabs (212) are arranged so as to be adapted to receive an end (106) of a second container (100), enabling the stacking of containers (100) through the use of the disclosed cover (1). See FIG. 5 for an example of stacked containers (100), shown as aluminum cans, using the disclosed cover (1) to enable the stacking of the containers (100).

Referring back to FIGS. 2A and 2B, the cover (1) comprises a release band (204) in accordance with one embodiment of the present invention. The release band (204) extends downward from the peripheral edge (203) of the top wall (200) and is located directly below the top wall (200). The release band (204) comprises an elongated strip having a top edge (205), a bottom edge (206), an inner surface (207), an opposing outer surface (208), and a thickness (209). The top edge (205) further comprises a first portion and a second portion. Referring again to FIG. 2A, the first portion of the top edge (205) of the release band (204) is permanently attached to the top wall (200) by one or more permanent attachment points (210). The second portion of the top edge (205) of the release band (204) is removably attached to the top wall (200) by one or more break-away attachment points (211).

In some embodiments, such as the one shown in FIGS. 2A and 2B, the release band (204) extends completely around the peripheral edge (203) of the top wall (200), forming a ring. In these embodiments, the release band (204) may include a break-off bead (216) extending vertically at a single point from the top edge (205) to the bottom edge (206) of the release band (204). The break-off bead (216) further comprises a thickness (218) (see FIGS. 2A, 2B and 4) that is smaller than the thickness (209) of the release band (204). The reduced thickness (218) of the break-off bead (216) relative to the thickness (209) in the rest of the release band (204) facilitates the breaking of the release band (204) to release the cover (1) from the container (100). In such embodiments, one of the one or more tabs (212) may be substantially aligned with the break-off bead (216) in order to provide an expanded gripping area (219).

In other embodiments (not shown), the release band (204) may only partially extend around the peripheral edge (203) of the top wall (200) leaving a gap to facilitate gripping the end of the release band (204). In such an embodiment, one of the one or more tabs (212) may also be placed at or near the end of the release band (204) to provide an expanded gripping area (219).

Figure 3:
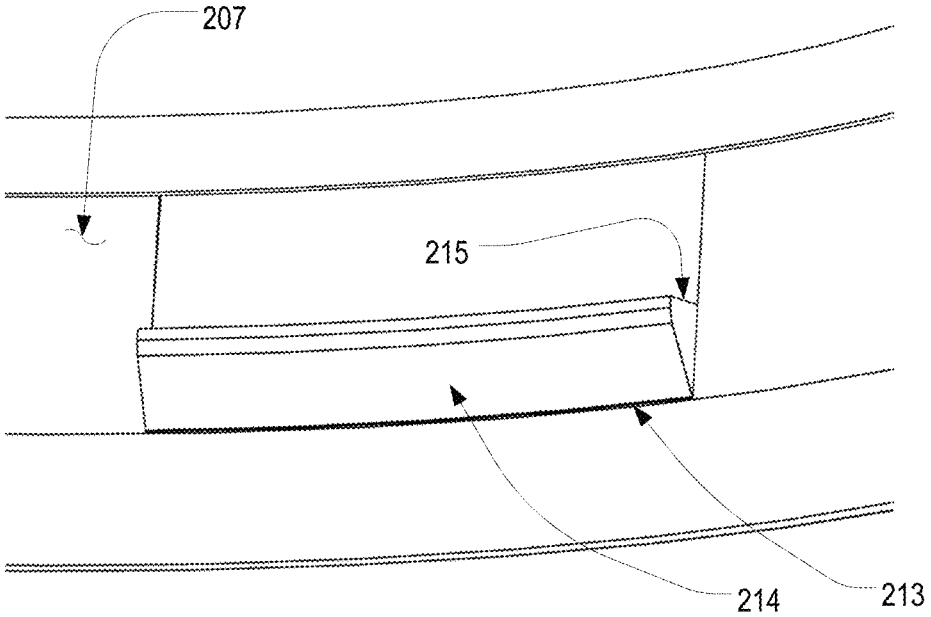
FIG. 3 illustrates an enlarged view of one of a plurality of locking elements of a cover in accordance with one embodiment of the present invention.

Now referring to FIGS. 2B and 3, a plurality of locking elements (213) is shown on a cover (1) in accordance with one embodiment of the present invention. The plurality of locking elements (213) extends inward from the inner surface (207) of the release band (204). It will be appreciated that the plurality of locking elements (213) generally defines a circle with a diameter that is smaller than the first diameter (104) but greater than the second diameter (105) of the rim (102) of the container (100). The plurality of locking elements (213) is adapted to engage the circular rim (102) of the container (100) and to prevent removal of the cover (1) from the container (100) once engaged. As further shown in FIGS. 2B and 3, the plurality of locking elements (213) can optionally be wedge-shaped, as shown in the disclosed embodiment, with a slope (214) which extends upwards and inwards from the bottom edge (206) (see FIG. 2A) of the release band (204) in order to facilitate insertion of the cover (1) over the circular rim (102) of the container (100). Referring again to FIG. 3, the plurality of locking elements (213) further comprises a top surface (215). The top surface (215) of the plurality of locking elements (213) is optionally substantially flat, as shown in the present embodiment, to prevent removal of the cover (1) once it is engaged with the circular rim (102) of the container (100).

Figure 4:
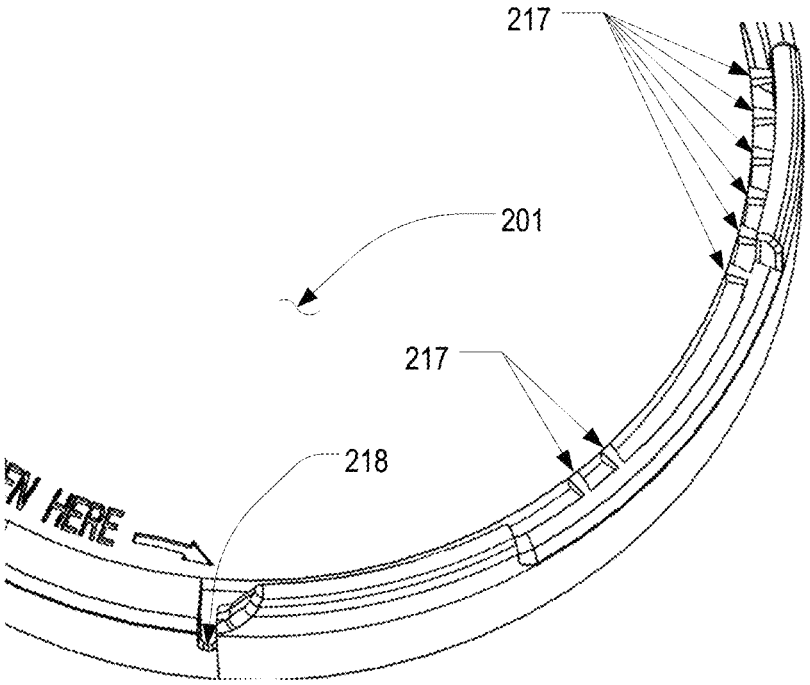
FIG. 4 illustrates an enlarged view of one or more break-away bridges of a cover in accordance with one embodiment of the present invention.

As shown in FIG. 4, the one or more break-away attachment points (211) of the release band (204) may further comprise a plurality of break-away bridges (217). In some embodiments, the cover (1) may comprise two or more break-away attachment points (211) with a plurality of break-away bridges (217). In such embodiments, each of the two or more break-away attachment points (211) may have the same number of break-away bridges (217). In other embodiments, at least two of the two or more break-away attachment points (211) may have a different number of break-away bridges (217). The greater the number of break-away bridges (217), the greater the break resistance for the corresponding break-away attachment point (211). In the example shown in FIG. 4, one of the break-away attachment points (211) has two break-away bridges (217) while the other break-away attachment point (211) has six break-away bridges (217). In some embodiments, it may be preferable to place a lower-resistance break-away attachment point (211) (i.e., comprising a lower number of break-away bridges (217)) in close proximity to the break-off bead (216) or the end of the release band (204) to make it easier to release the cover (1) from the container (100). Alternatively, the break-away attachment points (211) may simply comprise thinned beads, optionally of varying lengths to offer varying resistance, similar to the break-off bead (216).

Figure 6:
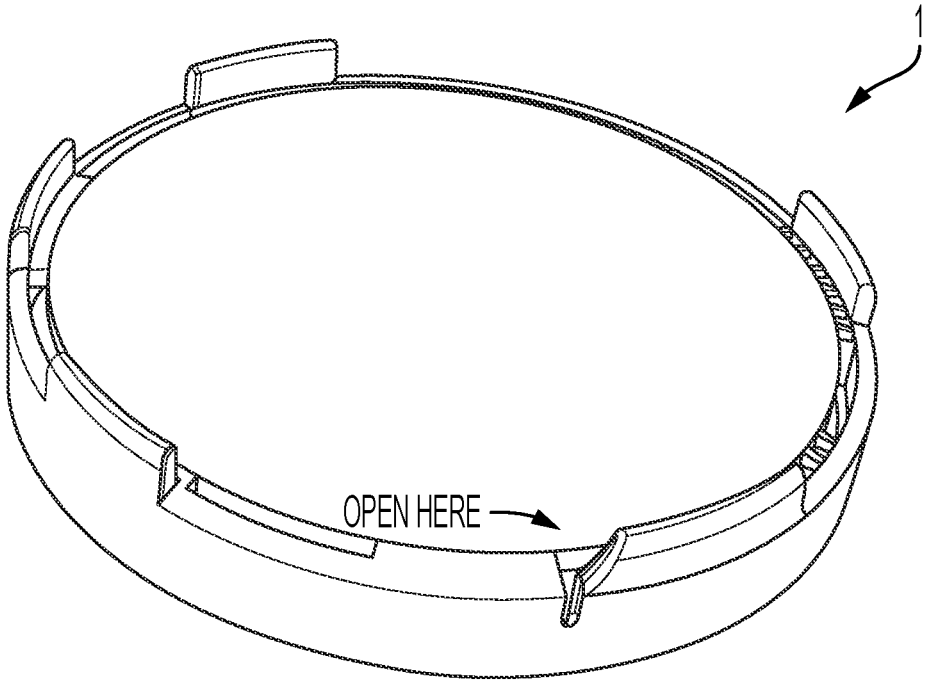
FIGS. 6 and 7 illustrate shaded renderings of isometric top and bottom views, respectively, of a cover in accordance with one embodiment of the present invention.
Figure 7:
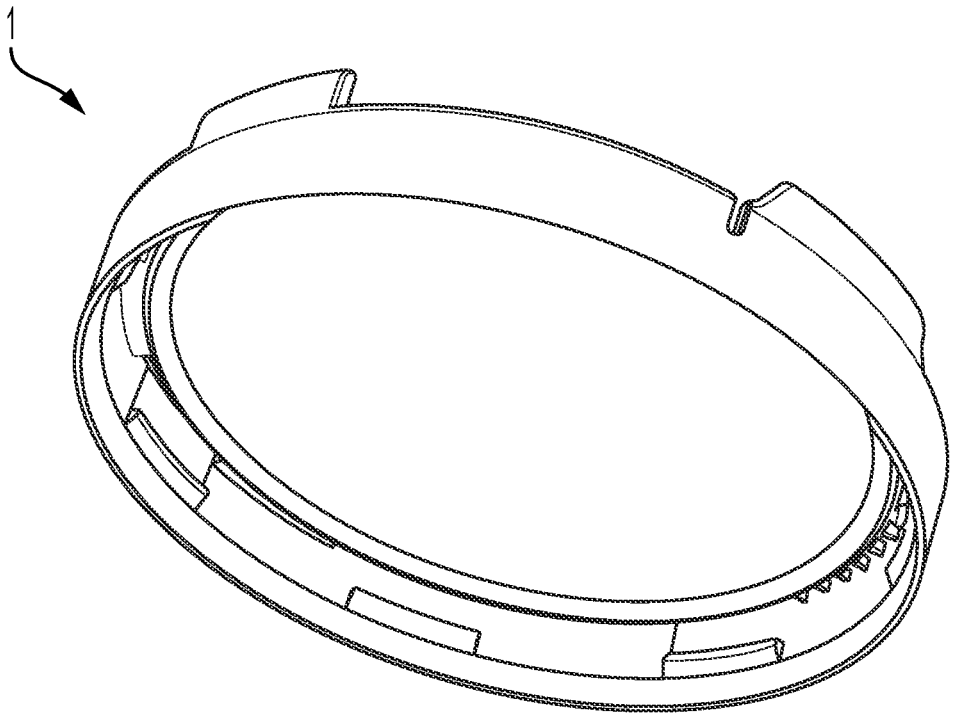

Finally, shown in FIGS. 6 and 7 are shaded renderings showing top and bottom isometric views, respectively, of the disclosed cover (1) in accordance with one embodiment of the present invention.

Figure 8:
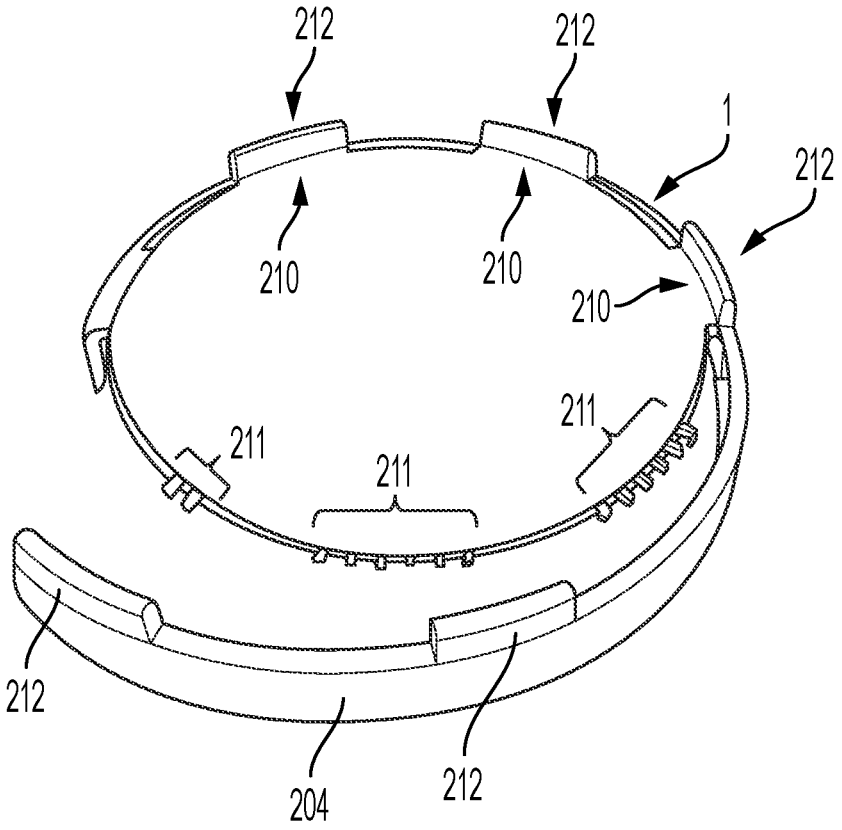
FIG. 8 illustrates an isometric view of a cover after removal from a container in accordance with one embodiment of the present invention.

In operation, the cover (1) is applied to a container (100) by placing it over the top of the container (100) until the plurality of locking elements (213) comes into contact with the circular rim (102) of the container (100). The cover (1) is then pressed down, temporarily deforming the plurality of locking elements (213) until they are urged past the rim (102) and again regain their original shape, locking the cover (1) onto the container (100). The horizontal top surface (215) of the plurality of locking elements (213) makes it very difficult for the cover (1) to accidentally disengage from the container (100). To remove the cover (1), the release band (204) is broken at the break-off bead (216) and pulled outwardly until one or more of the break-away attachment points (211) are broken, disengaging the plurality of locking elements (213) from the rim (102) of the container (100). Once a sufficient number of the plurality of locking elements (213) is disengaged from the rim (102), the cover (1) can be released from the container (100) exposing the opening mechanism (101) of the container (100). Shown in FIG. 8 is a cover (1) according to the present invention after it is removed from a container (100).

The cover (1) herein described can have unitary construction or be assembled for different components. Materials suitable for the cover (1) include polyethylene, polyethylene terephthalate, or any other resilient food-grade material, including food-grade plastics.

Although described above in connection with a child-resistant cover for aluminum cans, these descriptions are not intended to be limiting, as other covers can be made in accordance with the description herein, but of different size or scale, for use on other containers, as desired. As such, although the invention is illustrated and described herein, various modifications and structural changes may be made therein without departing from the spirit of the invention and within the scope and range of equivalents of the claims.

Any reference in this specification to "one embodiment," "an embodiment," an "example embodiment," etc., means that a particular feature, structure, or characteristic described in connection with the implementation is included in at least one embodiment of the invention. The appearances of such phrases in various places in the specification are not necessarily referring to the same embodiment. In addition, any elements or limitations of any invention or embodiment thereof disclosed herein can be combined with any and/or all other elements or limitations (individually or in any combination) or any invention or embodiment thereof disclosed herein, and all such combinations are contemplated with the scope of the invention without limitation thereto.

Although described above in connection with particular configurations, these descriptions are not intended to be limiting as various modifications may be made therein without departing from the spirit of the invention and within the scope and range of equivalents of the described embodiments. Encompassed embodiments of the present invention can be used in all containers calling for a child-resistant cover.

While a number of embodiments of the present invention have been described, it is understood that these examples and embodiments are illustrative only, and not restrictive, and that many modifications may become apparent to those of ordinary skill in the art and are to be included within the spirit and purview of this application. For example, any element described herein may be provided in any desired size (e.g., any element described herein may be provided in any desired custom size or any element described herein may be provided in any desired size selected from a "family" of sizes, such as small, medium, large). Further, one or more of the components may be made from many different suitable materials.

In addition, various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A cover for mounting on a container, the container comprising a circular rim, the rim defining a first diameter at a periphery of the container and a second diameter smaller than the first diameter and directly below the periphery of the container, the cover comprising:

a top wall comprising an exterior surface, an opposing interior surface, and a peripheral edge;

a release band extending downward from the peripheral edge of the top wall, the release band comprising a top edge, a bottom edge, an inner surface, an opposing outer surface, and a thickness;

the top edge of the release band comprising a first portion and a second portion, the first portion of the top edge of the release band being permanently attached to the top wall by one or more permanent attachment points, and the second portion of the top edge of the release band being removably attached to the top wall by one or more break-away attachment points;

one or more tabs extending upward on or near the peripheral edge of the top wall; and a plurality of locking elements extending inwardly from the inner surface of said release band, the plurality of locking elements defining a diameter that is smaller than the first diameter of the rim, but larger than the second diameter of the rim;

wherein the plurality of locking elements is adapted to engage the circular rim of the container and to prevent removal of the child-resistant cover from the container once engaged.

2. The cover of claim 1 wherein the top wall is solid.

3. The cover of claim 1 wherein the top wall has one or more openings extending from the exterior surface to the interior surface.

4. The cover of claim 1 wherein the top wall is planar.

5. The cover of claim 1 wherein the top wall is non-planar.

6. The cover of claim 5 wherein the top wall is concave.

7. The cover of claim 5 wherein the top wall is convex.

8. The cover of claim 1 wherein the release band extends completely around the peripheral edge of the top wall to form a ring.

9. The cover of claim 8 wherein the release band comprises a break-off bead extending vertically at a single point from the top edge to the bottom edge of the release band, the break-off bead having a thickness that is smaller than the thickness of the release band.

10. The cover of claim 9 wherein one of the one or more tabs is substantially aligned with the break-off bead.

11. The cover of claim 1 wherein the release band extends partially around the peripheral edge of the top wall to leave a gap.

12. The cover of claim 11 wherein one of the one or more tabs is placed at or near the end of the release band.

13. The cover of claim 1 wherein at least one of the one or more break-away attachment points comprises a plurality of break-away bridges.

14. The cover of claim 1 comprising two or more break-away attachment points, each of the two or more break-away attachment points comprising a plurality of break-away bridges.

15. The cover of claim 14 wherein the two or more break-away attachment points each comprise an equal number of break-away bridges.

16. The cover of claim 14 wherein at least two of the two or more break-away attachment points comprise a different number of break-away bridges.

17. The cover of claim 1 wherein the one or more tabs are arranged to receive an end of a second container.

* * * * *